US009441450B2

(12) United States Patent
Grainger

(10) Patent No.: US 9,441,450 B2
(45) Date of Patent: Sep. 13, 2016

(54) WELLBORE CEMENTING TOOL

(71) Applicant: Robert Grainger, Regina (CA)

(72) Inventor: Robert Grainger, Regina (CA)

( * ) Notice: Subject to any disclaimer, the term of this patent is extended or adjusted under 35 U.S.C. 154(b) by 381 days.

(21) Appl. No.: 14/033,754

(22) Filed: Sep. 23, 2013

(65) Prior Publication Data

US 2014/0083697 A1 Mar. 27, 2014

(30) Foreign Application Priority Data

Sep. 24, 2012 (CA) ..... 2790548

(51) Int. Cl.

| | |
|---|---|
| ***E21B 33/13*** | (2006.01) |
| ***E21B 33/128*** | (2006.01) |
| ***E21B 23/01*** | (2006.01) |
| ***E21B 33/14*** | (2006.01) |

(52) U.S. Cl.

CPC ..... *E21B 33/128* (2013.01); *E21B 23/01* (2013.01); *E21B 33/13* (2013.01); *E21B 33/14* (2013.01)

(58) Field of Classification Search

CPC ..... E21B 23/01; E21B 33/128; E21B 33/13; E21B 33/14; E21B 33/129

See application file for complete search history.

(56) References Cited

U.S. PATENT DOCUMENTS 3,706,342 A * 12/1972 Woolley ..... E21B 23/06 166/134
5,358,048 A * 10/1994 Brooks ..... E21B 33/127 166/285
6,142,227 A * 11/2000 Hiorth ..... E21B 33/129 166/123
2005/0194143 A1* 9/2005 Xu ..... E21B 43/10 166/285
2009/0107675 A1* 4/2009 Eriksen ..... E21B 7/20 166/285
2011/0011575 A1* 1/2011 Nguyen ..... E21B 23/01 166/87.1
2012/0085539 A1* 4/2012 Tonnessen ..... E21B 23/01 166/298
2013/0264068 A1* 10/2013 Hanson ..... E21B 21/103 166/373
2014/0083697 A1* 3/2014 Grainger ..... E21B 23/01 166/285
2014/0338889 A1* 11/2014 Grainger ..... E21B 23/01 166/179
2015/0159449 A1* 6/2015 Moyes ..... E21B 33/134 166/217

* cited by examiner

*Primary Examiner* — Daniel P Stephenson
(74) *Attorney, Agent, or Firm* — Olive Law Group, PLLC

(57) ABSTRACT

A wellbore cementing tool configured for placement in a drill string, and method of using same. The tool is lowered on a hollow, small-diameter stem into the drill string and contacts the bit, such that the downward pressure on the tool causes a shear pin to shear, resulting in upward movement of an outer sleeve relative to the central body of the tool. The outer sleeve normally holds outwardly biased locking members in a retracted position, but when the outer sleeve is upwardly displaced, slots in the outer sleeve align with the locking members and allow the locking members to extend outwardly through the slots to engage the inner wall of the drill string thereby locking the tool in place. When in position, cement can be injected through the tool and the bit, circulating up the wellbore annulus. The tool does not require rotation to engage the drill string.

14 Claims, 5 Drawing Sheets

WELLBORE CEMENTING TOOL

CROSS REFERENCE TO RELATED APPLICATION

This application claims priority to Canadian Patent Ser. No. 2,790,548, filed Sep. 24, 2012, the entire contents of which are hereby incorporated by reference herein.

TECHNICAL FIELD

The invention relates to wellbore drilling technology, and specifically to tools and methods for cementing in a wellbore.

BACKGROUND

In the practice of borehole or wellbore drilling, a rotary drilling apparatus is employed to drill a hole downwardly into the ground, normally to either determine subsurface conditions, obtain samples of subsurface materials, or to extract natural resources located at depth. It is known to inject specialized cementitious material into the borehole to stabilize the hole walls or allow for isolation of certain subsurface strata.

Various cementing tools and methods have been developed over the years, often for mining or oil and gas drilling applications. While they have achieved generally widespread use and acceptance, it is known that certain drilling tools manifest potentially disadvantageous features. For example, some drilling tools are intended for deployment at a certain depth in the borehole, but locking them in place at that desired depth may require rotation of the tool and/or the string or stem used to deploy the tool, with the risk that threaded sections of drill pipe—in which the tool is being deployed—may be loosened at depth, a potentially serious occurrence. Also, some cementing tools can only be positioned when the drill string has first been removed from the hole, a practice known as tripping out the drill string. Tripping out the drill string can be time consuming and, in some contexts, otherwise unnecessary or undesirable.

It would therefore be desirable to have a wellbore cementing tool that could be employed without tripping out the drill string or requiring rotation that might destabilize the string in place.

SUMMARY

The present invention therefore seeks to provide a wellbore cementing tool and method for using same, where the tool can be deployed within an in-place drill string and locked in place at a desired depth without requiring tool rotation.

According to a first aspect of the present invention there is provided a wellbore cementing tool comprising an inner body and an outer sleeve disposed on an external surface of the inner body, the inner body supporting outwardly-biased locking members and the outer sleeve comprising apertures; wherein the outer sleeve is moved from a first downwardly disposed position to a second upwardly disposed position when the tool is lowered into a wellbore and contacts a downhole obstacle; wherein the locking members are held in a disengaged position by the outer sleeve when the outer sleeve is in the first position; and wherein the locking members extend through the apertures when the outer sleeve is in the second position.

According to a second aspect of the present invention there is provided a method for cementing a wellbore using the tool described above, wherein the method comprises the steps of: lowering the tool on a hollow stem into a drill string until the tool contacts a downhole obstacle; forcing the inner body of the tool downward relative to the outer sleeve; allowing the apertures of the outer sleeve to align with the locking members; allowing the locking members to be biased to pass outwardly through the apertures to engage the inner surface of the drill string; and injecting cementitious material down the hollow stem, through the tool, and through the lower end of the drill string such that the cementitious material passes out of the drill string and travels upwardly in the annulus between the drill string and the wellbore. The tool is preferably provided with a lower valve to prevent the cementitious material from flowing back into the tool, and a plug is preferably employed after injection of the cementitious material to plug the tool.

A detailed description of an exemplary embodiment of the present invention is given in the following. It is to be understood, however, that the invention is not to be construed as being limited to this embodiment.

BRIEF DESCRIPTION OF THE DRAWINGS

In the accompanying drawings, which illustrate an exemplary embodiment of the present invention.

Exemplary embodiments of the present invention will now be described with reference to the accompanying drawings

DETAILED DESCRIPTION

Figure 1:
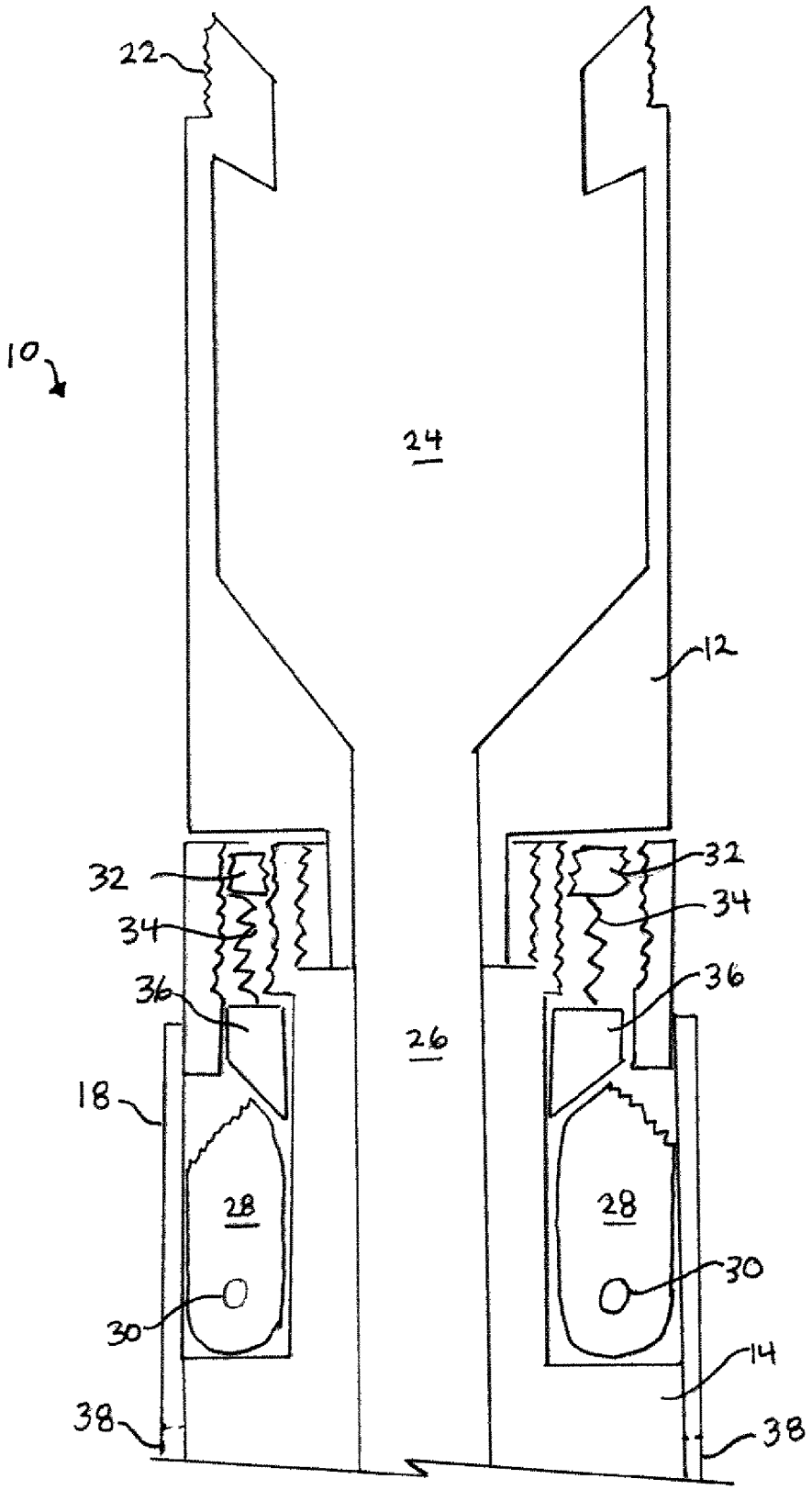
FIG. 1 is a simplified sectional view of an upper portion of a tool according to the present invention.
Figure 2:
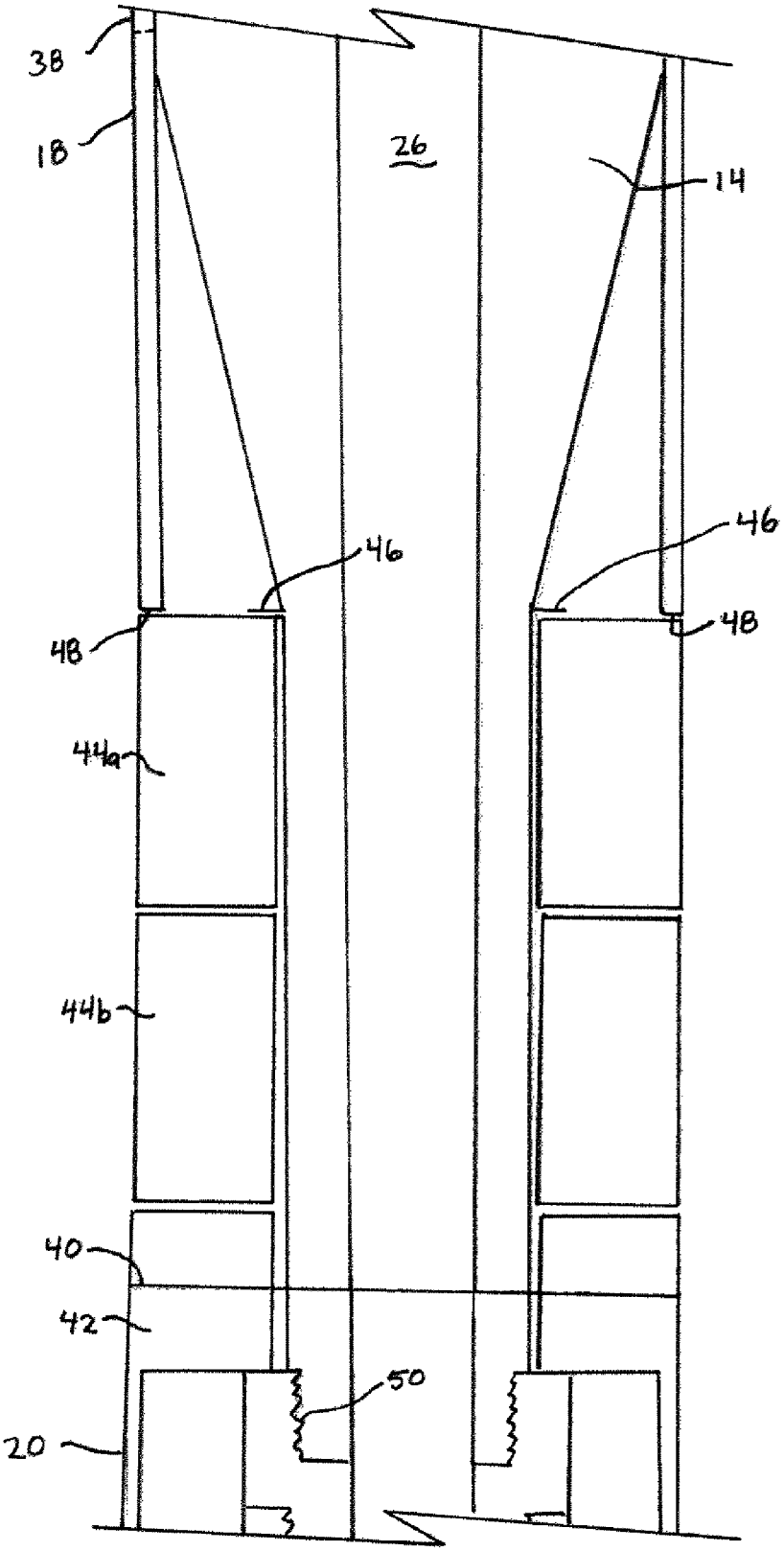
FIG. 2 is a simplified sectional view of a middle portion of the tool of FIG. 1.
Figure 3:
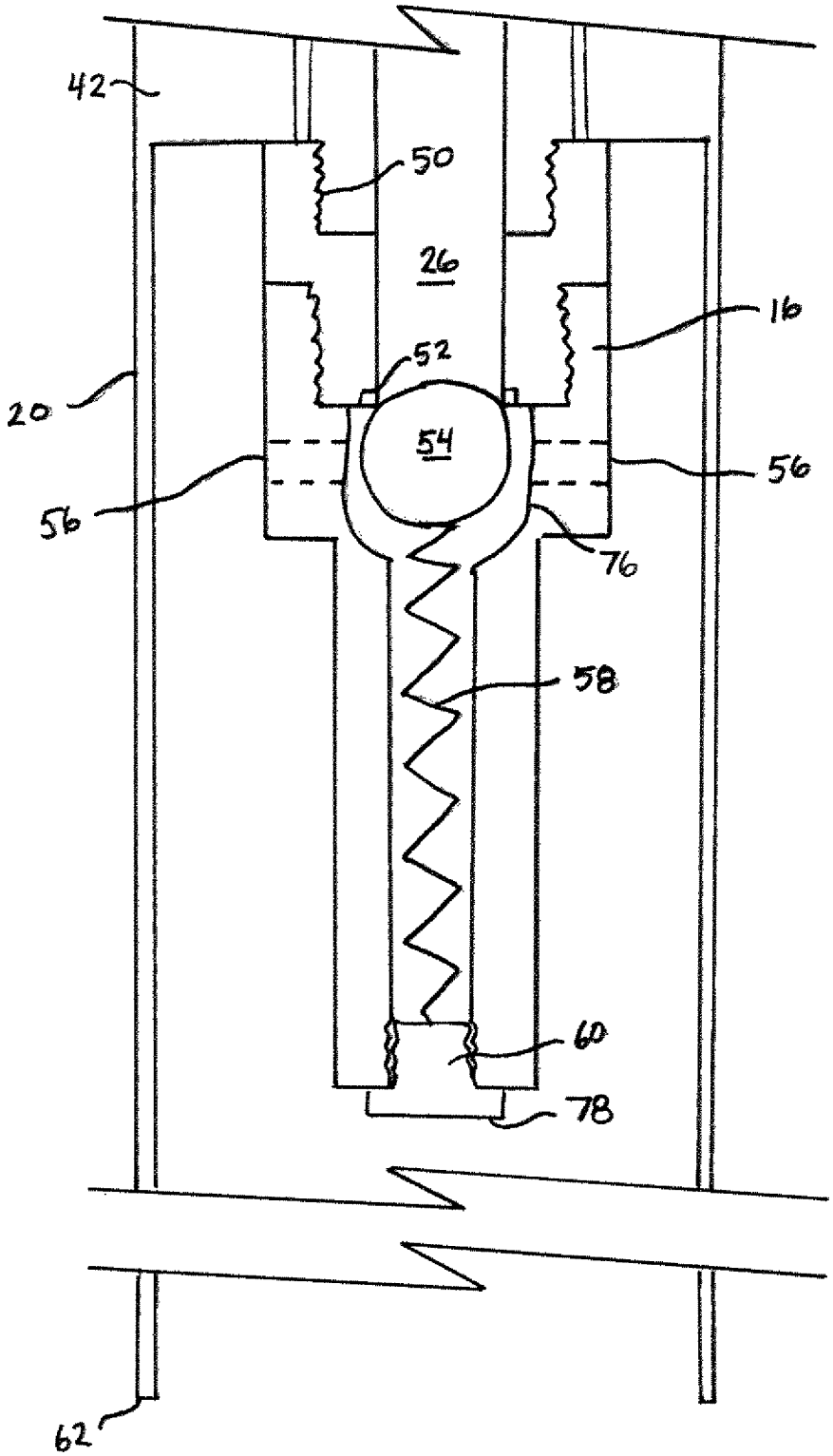
FIG. 3 is a simplified sectional view of a lower portion of the tool of FIG. 1.

In the following description, an exemplary tool according to the present invention is identified by the numeral 10. Referring specifically to FIGS. 1 to 3, the tool 10 comprises an upper body 12, a middle body 14, and a lower body 16, all threadably engaged in a manner well known in the art of drilling technologies. An upper metal sleeve 18 is disposed around the middle body 14 for movement relative thereto, as will be described below. A lower metal sleeve 20, shown particularly in FIG. 3, is disposed around the lower body 16 and extends downwardly past the lowest extent of the lower body 16, such that the lower sleeve 20 is the part of the tool 10 that contacts the downhole obstacle.

The tool 10 is provided with a threaded section 22 for engagement with a hollow stem (not shown); the threaded section 22 is preferably a left-hand thread to help avoid unwanted rotation of the adjacent drill string connections when the hollow stem is disengaged from the tool 10 after use. The hollow stem or string is used to lower the tool 10 into position within the drill string (not shown) and to flow cementitious material to the tool 10. The tool 10 is provided with a central cavity 26 which extends from the upper end of the tool 10 to the lower body 16 where cementitious materials are allowed to exit through apertures 56, and the cavity 26 comprises a larger chamber 24 in the upper body 12. The chamber 24 is present to receive and retain a plug 64, as is discussed below.

The upper body 12 is threadably engaged with the middle body 14, as can be seen in FIG. 1, and the middle body 14 supports the means for securing the tool 10 in a desired location in the wellbore. The tool 10 of the exemplary embodiment is configured to be permanently secured inside the drill string, and so the desired location in this case would be the bottom of the hole at the desired drilling depth, with the downhole obstacle being the upper surface of the drill bit; however, it would be obvious to one skilled in the art that other configurations and other drilling applications are possible within the scope of the invention.

The securing means comprise four locking members 28 (two of which are visible in FIG. 1, the four locking members 28 being disposed at equal distances around the tool 10). The locking members 28 are pivotally mounted on the middle body 14 by means of pivot pins 30, such that the locking members 28 are rotatable from a first position shown in FIG. 1 to a second position rotated away from the middle body 14. The locking members 28 are biased toward the second position by means of wedges 36 which are driven downwardly by springs 34, the spring 34 in turn controlled by set screws 32. The wedges 36 are driven downwardly by the springs 34, but the angled contact face of the wedge 36 imparts an outward rotation of the locking member 28.

Figure 4A:
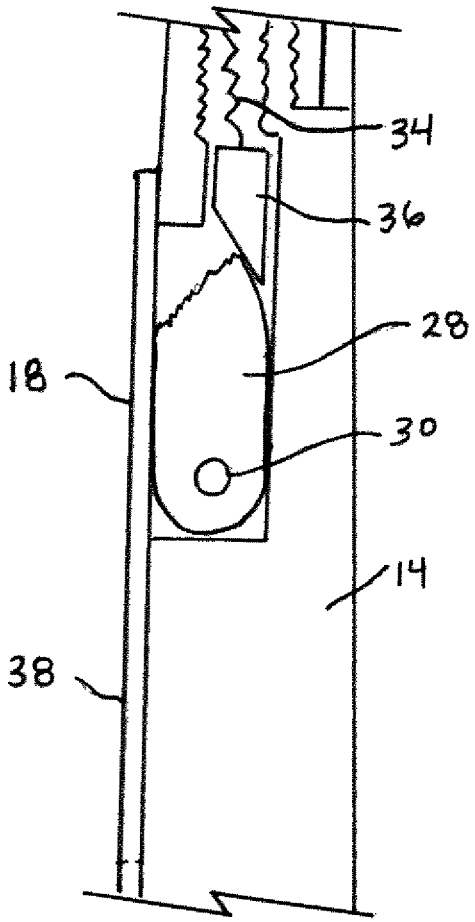
FIG. 4*a* is a simplified sectional view showing the locking members in a disengaged position.
Figure 4B:
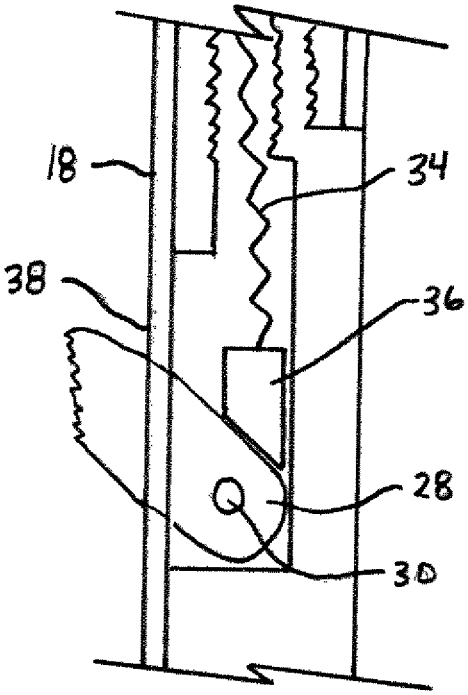
FIG. 4*b* is a simplified sectional view showing the locking members in an engaged position.

In the position shown in FIG. 1, however, the locking members 28 cannot rotate outwardly due to the presence of the upper sleeve 18. Turning now to FIGS. 4*a* and 4*b*, the means for allowing the locking members 28 to rotate outwardly is illustrated. In FIG. 4*a*, the upper sleeve 18 is disposed in a generally downward orientation, such that slots 38 in the upper sleeve 18 are positioned below the locking members 28. When the slots 38 are not aligned with the locking members 28, the locking members 28 cannot extend through the upper sleeve 18. However, the upper sleeve 18 can be raised relative to the middle body 14, such that the slots 38 align with the locking members 28 and allow the locking members 28 to extend through the upper sleeve 18, as can be seen in FIG. 4*b*. The mechanism for allowing the upper sleeve 18 to move upwardly relative to the middle body 14 and allow the locking members 28 to pass through the slots 38 is described below.

Turning now to FIGS. 2 and 3, the lower sleeve 20 is shown mounted on the middle body 14 and extending downwardly to cover the lower body 16. As the lower sleeve 20 is the lowest part of the tool 10 when installed in a drill string, it is obvious that the lower end 62 of the lower sleeve 20 will be the part of the tool 10 that contacts the downhole obstacle (in this case a drill bit). The lower sleeve 20 is mounted on a steel bushing 42 which wraps around the middle body 14, and the bushing 42 is secured to the middle body 14 by a shear pin 40. The bushing 42 is overlain by rubber sleeves 44*a*, 44*b*, and the uppermost rubber sleeve 44*a* is connected to the upper sleeve 18 by means of screws 48. The rubber sleeves 44*a*, 44*b* are held in position by a plastic ring 46. The lower body 16 is mounted at the lower end of the middle body 14 by means of a threaded engagement 50.

The lower body 16 is illustrated in FIG. 3 and functions both to allow passage of cementitious material to the bit and as a backflow preventer when the tool 10 is installed. The lower body 16 comprises a ball chamber 76 that is positioned at the lower extent of the cavity 26. The ball chamber 76 houses a ball 54 which allows cementitious material to pass from the cavity 26 through four equally radially disposed apertures 56 and out of the tool 10. In the event of backflow into the chamber 76, the ball 54 instead presses upwardly against a hardened seat ring 52 and thereby prevents backflow into the cavity 26. The ball 54 is biased upwardly by means of a spring 58, which spring 58 is controlled by means of a pressure-adjusting screw 60 (which can be rotated by means of a hexagonal head 78).

Figure 5:
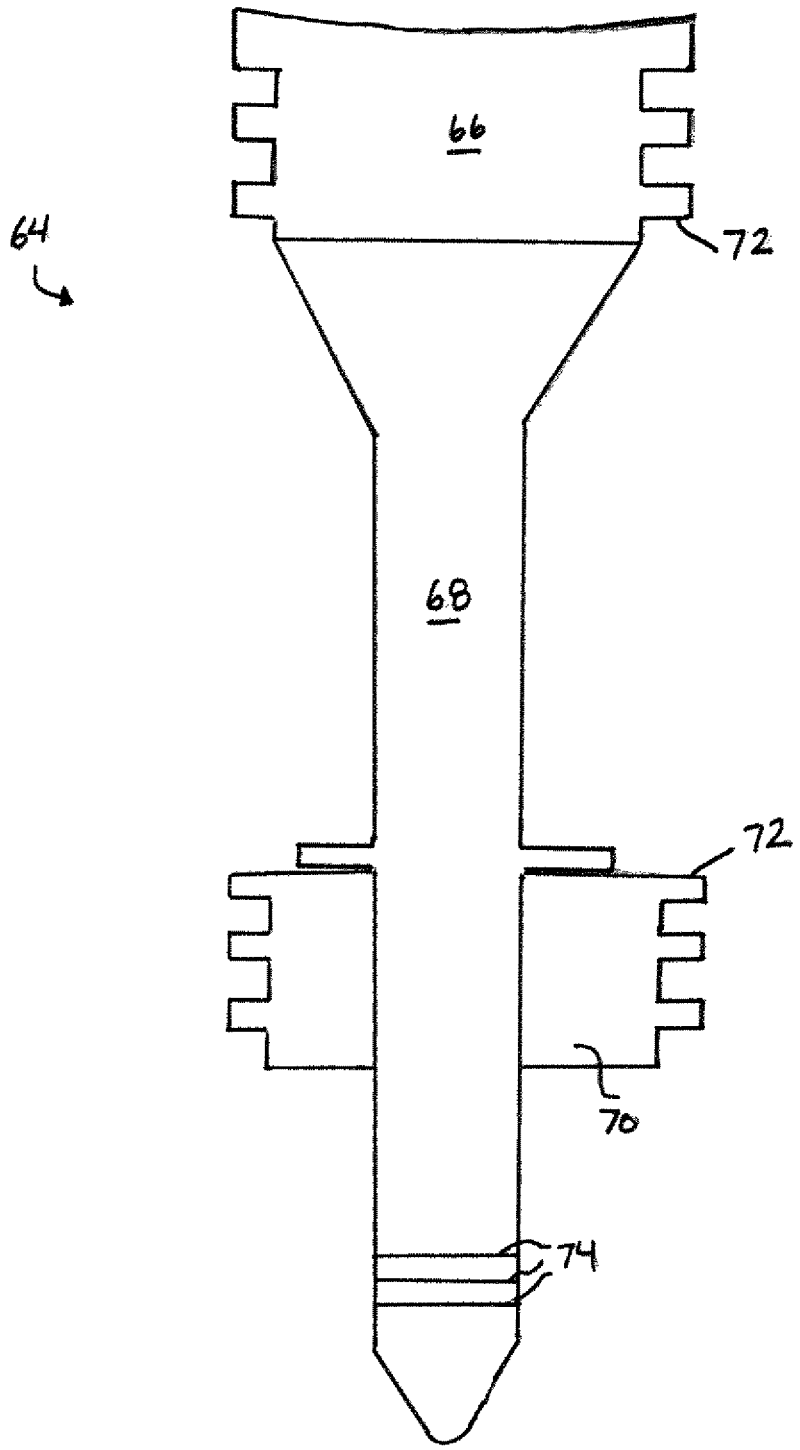
FIG. 5 is a simplified sectional view of a plug according to the present invention.

Turning now to FIG. 5, a plug 64 is illustrated. The plug 64 is to be inserted into the tool 10 after injection of a desired volume of cementitious material. The plug 64 comprises an upper rubber member 66, a shaft 68, and a lower rubber member 70. Each of the rubber members 66, 70 are provided with ribs or projections 72 of rubber to contact adjacent walls. The lower part of the plug 64 is inserted into the cavity 26 immediately below the chamber 24, and is therefore provided with three O-rings 74.

Use of the tool 10 will now be described. When a user wishes to cement a drilled borehole, the tool 10 is threadably connected to a hollow stem and then lowered into the interior of the drill string. When the tool 10 reaches the end of the drill string, the lower end 62 of the lower sleeve 20 strikes the drill bit. As downward force continues to be applied to the tool 10, however, the central body of the tool 10 (specifically the threadably connected upper body 12 and middle body 14) is pushed downward relative to the lower sleeve 20 and the bushing 42 on which the sleeve 20 is mounted. This causes the shear pin 40 to rupture, allowing movement of the lower sleeve 20 and bushing 42 relative to the middle body 14. As the bushing 42 has been freed to move upwardly relative to the middle body 14, the bushing 42 presses upwardly against the rubber sleeves 44*a,b*. This upward movement is now applied to the rubber sleeves 44*a,b*, causing the plastic ring 46 to rupture and drive the upper sleeve 18 upwardly relative to the middle body 14. The rubber sleeves 44*a,b* are also pressed outwardly toward the inner surface of the drill string due to the angled surface of the middle body 14, thereby forming a seal against the drill string and preventing any backflow of cementitious material around the tool 10 and upwards within the drill string.

As the rubber sleeves 44*a,b* push the upper sleeve 18 upwardly relative to the middle body 14, the upper sleeve 18 moves from the first position shown in FIG. 4*a* to the second position shown in FIG. 4*b*. When the slots 38 move into position adjacent the locking members 28, the locking members 28 are outwardly biased through the slots 38 and engage the inner surfaces of the drill string. The tool 10 is then secured within the drill string immediately above the bit, and cementing can begin.

Cementitious material is then injected into the hollow stem, downwardly toward the tool 10. The cementitious material passes into the chamber 24 and thence into the cavity 26, ultimately passing out the apertures 56 and downwardly toward the bit, where it will pass through the bit and into the annulus between the drill string and borehole walls.

Once a volume of cementitious material has been injected that the user has determined will be adequate for the desired cementing activity, the plug 64 is sent down the hollow stem to the tool 10. Once the plug 64 reaches the tool 10, it presses into the chamber 24, where the lower rubber member 70 terminates travel in the chamber 24 and the O-rings 74 seal against the upper end of the cavity 26. The upper rubber member 66 helps to centralize and stabilize the plug 64. Once in position, the plug 64 prevents any material from passing through the tool 10 to the bit. In addition, the ball 54 presses upwardly against the hardened seat ring 52 to prevent backflow into the cavity 26, while the rubber sleeves 44*a,b* prevent backflow around the outside of the tool 10. The hollow stem can then be disengaged from the threaded section 22 and tripped out of the hole, leaving the tool 10 in position adjacent the bit.

As can be readily seen, then, there are numerous advantages provided by the present invention. First, the tool can be deployed and allowed to engage the inner surface of a drill string without rotation of the tool. Also, the tool can be deployed in an in-place drill string, so no tripping out is required. The use of the ball valve and plug help prevent undesired flow of cementitious material in either direction, and the plug itself can be used to clean out the hollow stem as it travels downwardly toward the tool.

The foregoing is considered as illustrative only of the principles of the invention. Thus, while certain aspects and embodiments of the invention have been described, these have been presented by way of example only and are not intended to limit the scope of the invention. The scope of the claims should not be limited by the exemplary embodiments set forth in the foregoing, but should be given the broadest interpretation consistent with the specification as a whole.

What is claimed:

1. A tool for use in cementing a wellbore, the tool comprising:

an inner body, the inner body comprising a passage therethrough for receiving cementitious material, the inner body further comprising outwardly-biased locking members configured to engage an inner surface of the wellbore; and an outer sleeve slidably disposed adjacent an external surface of the inner body, the outer sleeve comprising apertures configured to selectively align with the locking members;

wherein the outer sleeve is movable from a first downwardly disposed position relative to the inner body to a second upwardly disposed position relative to the inner body when the tool is lowered into the wellbore and contacts a downhole obstacle;

wherein the apertures and the locking members are out of alignment when the outer sleeve is in the first position, such that the locking members are held in a disengaged position by the outer sleeve; and wherein the apertures and the locking members are aligned when the outer sleeve is in the second position, such that the locking members extend through the apertures for engagement with the inner surface of the wellbore.

2. The tool of claim 1 wherein the downhole obstacle is a drill bit and the locking members are configured to engage inner surfaces of a drill string within the wellbore.

3. The tool of claim 1 wherein the inner body comprises a threaded end for threadable engagement with a hollow stem, the hollow stem for supplying the cementitious material to the passage.

4. The tool of claim 1 wherein the inner body comprises openings extending from the passage to an area external to the tool for release of cementitious material into the area.

5. The tool of claim 4 wherein the inner body comprises a backflow preventer to prevent backflow of cementitious materials through the openings into the passage.

6. The tool of claim 1 wherein the passage is configured to receive and retain a plug to terminate supply of the cementitious material to the passage.

7. The tool of claim 1 wherein the locking members are pivotally mounted on the inner body.

8. The tool of claim 1 wherein the outer sleeve extends downwardly past a lowest extent of the inner body.

9. The tool of claim 8 wherein the outer sleeve comprises an upper sleeve and a lower sleeve separated by a shear pin, the shear pin configured to rupture when the lower sleeve contacts the downhole obstacle and thereby allow upward movement of the upper sleeve into the second position.

10. The tool of claim 9 further comprising a deformable sleeve disposed between the upper sleeve and the lower sleeve, the deformable sleeve configured to move outwardly toward the inner surface of the wellbore for sealing engagement therewith when the upper and lower sleeves move upwardly into the second position.

11. A method for cementing a wellbore, wherein the method comprises the steps of:

a. providing a tool comprising an inner body, an outer sleeve slidable relative to the inner body between first and second positions, a passage through the inner body for receiving and directing cementitious material through the tool, and locking means for securing the tool in place in the wellbore, the locking means engageable when the outer sleeve is in the second position;

b. lowering the tool on a hollow stem into the wellbore until the tool contacts a downhole obstacle;

c. forcing the inner body of the tool downward relative to the outer sleeve;

d. allowing the outer sleeve to enter the second position;

e. allowing the locking means to engage the wellbore; an f. injecting the cementitious material down the hollow stem and through the passage, such that the cementitious material passes out of the tool and into the wellbore.

12. The method of claim 11 wherein the tool further comprises a lower valve to prevent the cementitious material from flowing back into the tool.

13. The method of claim 11 wherein a plug is employed after injection of the cementitious material to plug the tool.

14. The method of claim 11 wherein the tool is lowered into a drill string in the wellbore and the downhole obstacle is a drill bit, such that:

the locking means engage inner surfaces of the drill string; and the cementitious material passes through the tool and out of the drill string and travels upwardly in the annulus between the drill string and the wellbore.

* * * * *